US009730570B2

(12) United States Patent
Geda

(10) Patent No.: US 9,730,570 B2
(45) Date of Patent: Aug. 15, 2017

(54) REDUCED SOUND WITH A ROTATING FILTER FOR A DISHWASHER

(71) Applicant: Whirlpool Corporation, Benton Harbor, MI (US)

(72) Inventor: Jacquelyn R. Geda, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 383 days.

(21) Appl. No.: 14/341,934

(22) Filed: Jul. 28, 2014

(65) Prior Publication Data

US 2014/0332040 A1 Nov. 13, 2014

Related U.S. Application Data

(63) Continuation-in-part of application No. 13/483,254, filed on May 30, 2012, now Pat. No. 9,237,836.

(51) Int. Cl.
*A47L 15/42* (2006.01)

(52) U.S. Cl.
CPC ..... *A47L 15/4206* (2013.01); *A47L 15/4208* (2013.01); *A47L 15/4219* (2013.01); *A47L 15/4225* (2013.01)

(58) Field of Classification Search
None
See application file for complete search history.

(56) References Cited

U.S. PATENT DOCUMENTS

| | | | |
|---|---|---|---|
| 1,617,021 | A | 2/1927 | Mitchell |
| 2,154,559 | A | 4/1939 | Bilde |
| 2,422,022 | A | 6/1947 | Koertge |
| 2,734,122 | A | 2/1956 | Flannery |
| 3,016,147 | A | 1/1962 | Cobb et al. |
| 3,026,628 | A | 3/1962 | Berger, Sr. et al. |
| 3,068,877 | A | 12/1962 | Jacobs |
| 3,103,227 | A | 9/1963 | Long |
| 3,122,148 | A | 2/1964 | Alabaster |
| 3,186,417 | A | 6/1965 | Fay |
| 3,288,154 | A | 11/1966 | Jacobs |
| 3,378,933 | A | 4/1968 | Jenkins |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

German Search Report for DE102013103625, Jul. 19, 2013.

(Continued)

*Primary Examiner* — Michael Barr
*Assistant Examiner* — Rita Adhlakha
(74) *Attorney, Agent, or Firm* — McGarry Bair PC

(57) ABSTRACT

A dishwasher with a tub at least partially defining a washing chamber, a liquid spraying system, a liquid recirculation system defining a recirculation flow path, and a liquid filtering system. The liquid filtering system includes a rotating filter disposed in the recirculation flow path to filter the liquid and a flow diverter wherein liquid passing through a gap between the flow diverter and the rotating filter applies a greater shear force on the surface than liquid in an absence of the flow diverter.

20 Claims, 9 Drawing Sheets

(56) References Cited

U.S. PATENT DOCUMENTS 3,542,594 A 11/1970 Smith et al.
3,575,185 A 4/1971 Barbulesco
3,586,011 A 6/1971 Mazza
3,739,145 A 6/1973 Woehler
3,801,280 A 4/1974 Shah et al.
3,846,321 A 11/1974 Strange
3,906,967 A 9/1975 Bergeson
3,989,054 A 11/1976 Mercer
4,179,307 A 12/1979 Cau et al.
4,180,095 A 12/1979 Woolley et al.
4,228,962 A 10/1980 Dingler et al.
4,326,552 A 4/1982 Bleckmann
4,359,250 A * 11/1982 Jenkins ..... A47L 15/4246 312/228
4,754,770 A 7/1988 Fornasari
5,002,890 A 3/1991 Morrison
5,030,357 A 7/1991 Lowe
5,133,863 A 7/1992 Zander
5,331,986 A 7/1994 Lim et al.
5,454,298 A 10/1995 Lu
5,470,142 A 11/1995 Sargeant et al.
5,470,472 A 11/1995 Baird et al.
5,557,704 A 9/1996 Dennis et al.
5,569,383 A 10/1996 Vander Ark, Jr. et al.
5,618,424 A 4/1997 Nagaoka
5,630,437 A 5/1997 Dries et al.
5,711,325 A 1/1998 Kloss et al.
5,755,244 A 5/1998 Sargeant et al.
5,782,112 A 7/1998 White et al.
5,803,100 A 9/1998 Thies
5,865,997 A 2/1999 Isaacs
5,868,937 A 2/1999 Back et al.
5,904,163 A 5/1999 Inoue et al.
5,924,432 A 7/1999 Thies et al.
6,289,908 B1 9/2001 Kelsey
6,389,908 B1 5/2002 Chevalier et al.
6,443,091 B1 9/2002 Matte
6,460,555 B1 10/2002 Tuller et al.
6,491,049 B1 12/2002 Tuller et al.
6,601,593 B2 8/2003 Deiss et al.
6,666,976 B2 12/2003 Benenson, Jr. et al.
6,800,197 B1 10/2004 Kosola et al.
6,997,195 B2 2/2006 Durazzani et al.
7,047,986 B2 5/2006 Ertle et al.
7,069,181 B2 6/2006 Jerg et al.
7,093,604 B2 8/2006 Jung et al.
7,153,817 B2 12/2006 Binder
7,198,054 B2 4/2007 Welch
7,208,080 B2 4/2007 Batten et al.
7,232,494 B2 6/2007 Rappette
7,250,174 B2 7/2007 Lee et al.
7,270,132 B2 9/2007 Inui et al.
7,319,841 B2 1/2008 Bateman, III et al.
7,326,338 B2 2/2008 Batten et al.
7,347,212 B2 3/2008 Rosenbauer
7,350,527 B2 4/2008 Gurubatham et al.
7,363,093 B2 4/2008 King et al.
7,406,843 B2 8/2008 Thies et al.
7,445,013 B2 11/2008 VanderRoest et al.
7,497,222 B2 3/2009 Edwards et al.
7,523,758 B2 4/2009 VanderRoest et al.
7,594,513 B2 9/2009 Vanderroest et al.
7,819,983 B2 10/2010 Kim et al.
7,896,977 B2 3/2011 Gillum et al.
8,043,437 B1 10/2011 Delgado et al.
8,161,986 B2 4/2012 Alessandrelli
8,215,322 B2 7/2012 Fountain et al.
8,627,832 B2 1/2014 Fountain et al.
8,667,974 B2 3/2014 Fountain et al.
8,746,261 B2 6/2014 Welch
9,005,369 B2 4/2015 Delgado et al.
9,010,344 B2 * 4/2015 Tuller ..... A47L 15/4206 134/110
9,034,112 B2 5/2015 Tuller et al.
2002/0017483 A1 2/2002 Chesner et al.
2003/0037809 A1 2/2003 Favaro
2003/0168087 A1 9/2003 Inui et al.
2003/0205248 A1 11/2003 Christman et al.
2004/0007253 A1 1/2004 Jung et al.
2004/0103926 A1 6/2004 Ha
2004/0254654 A1 12/2004 Donnelly et al.
2005/0022849 A1 2/2005 Park et al.
2005/0133070 A1 6/2005 Vanderroest et al.
2006/0005863 A1 1/2006 Gurubatham et al.
2006/0054549 A1 3/2006 Schoendorfer
2006/0123563 A1 6/2006 Raney et al.
2006/0162744 A1 7/2006 Walkden
2006/0174915 A1 8/2006 Hedstrom et al.
2006/0236556 A1 10/2006 Ferguson et al.
2006/0237049 A1 10/2006 Weaver et al.
2006/0237052 A1 10/2006 Plcardat et al.
2007/0006898 A1 1/2007 Lee
2007/0107753 A1 5/2007 Jerg
2007/0119478 A1 5/2007 King et al.
2007/0124004 A1 5/2007 King et al.
2007/0163626 A1 7/2007 Klein
2007/0186964 A1 8/2007 Mason et al.
2007/0246078 A1 10/2007 Purtilo et al.
2007/0266587 A1 11/2007 Bringewatt et al.
2007/0295360 A1 12/2007 Jerg et al.
2008/0116135 A1 5/2008 Rieger et al.
2008/0190464 A1 * 8/2008 Stahlmann ..... A47L 15/4204 134/110
2008/0289654 A1 11/2008 Kim et al.
2008/0289664 A1 11/2008 Rockwell et al.
2009/0095330 A1 4/2009 Iwanaga et al.
2009/0283111 A1 11/2009 Classen et al.
2010/0012159 A1 1/2010 Verma et al.
2010/0043826 A1 2/2010 Bertsch et al.
2010/0043828 A1 2/2010 Choi et al.
2010/0043847 A1 2/2010 Yoon et al.
2010/0121497 A1 5/2010 Heisele et al.
2010/0147339 A1 6/2010 Bertsch et al.
2010/0154830 A1 6/2010 Lau et al.
2010/0154841 A1 6/2010 Fountain et al.
2010/0175762 A1 7/2010 Anacrelico
2010/0224223 A1 9/2010 Kehl et al.
2010/0252081 A1 10/2010 Classen et al.
2010/0300499 A1 12/2010 Han et al.
2011/0061682 A1 3/2011 Fountain et al.
2011/0120508 A1 5/2011 Yoon et al.
2011/0126865 A1 6/2011 Yoon et al.
2011/0146730 A1 6/2011 Welch
2012/0097200 A1 4/2012 Fountain
2012/0138107 A1 6/2012 Fountain et al.
2012/0167928 A1 7/2012 Fountain et al.
2012/0291805 A1 11/2012 Tuller et al.
2012/0291822 A1 11/2012 Tuller et al.
2012/0318295 A1 * 12/2012 Delgado ..... A47L 15/0039 134/10
2012/0318309 A1 12/2012 Tuller et al.
2013/0220386 A1 * 8/2013 Jozwiak ..... A47L 15/4206 134/111

FOREIGN PATENT DOCUMENTS

CN 2761660 3/2006
CN 1966129 5/2007
CN 2907830 6/2007
CN 101406379 4/2009
CN 201276653 7/2009
CN 201361486 12/2009
CN 101654855 2/2010
CN 201410325 2/2010
CN 201473770 5/2010
DE 1134489 8/1961
DE 1428358 A1 11/1968
DE 1453070 3/1969
DE 7105474 8/1971
DE 7237309 U 9/1973
DE 2825242 A1 1/1979
DE 3337369 A1 4/1985
DE 3723721 A1 5/1988
DE 3842997 A1 7/1990

(56) References Cited

FOREIGN PATENT DOCUMENTS

| | | | | |
|---|---|---|---|---|
| DE | 4011834 | A1 | 10/1991 | |
| DE | 4016915 | A1 | 11/1991 | |
| DE | 4131914 | A1 | 4/1993 | |
| DE | 9415486 | U1 | 11/1994 | |
| DE | 9416710 | U1 | 1/1995 | |
| DE | 4413432 | C1 | 8/1995 | |
| DE | 4418523 | A1 | 11/1995 | |
| DE | 4433842 | | 3/1996 | |
| DE | 69111365 | T2 | 3/1996 | |
| DE | 19546965 | A1 | 6/1997 | |
| DE | 69403957 | T2 | 1/1998 | |
| DE | 19652235 | | 6/1998 | |
| DE | 10000772 | A1 | 7/2000 | |
| DE | 69605965 | T2 | 8/2000 | |
| DE | 19951838 | A1 | 5/2001 | |
| DE | 10065571 | A1 | 7/2002 | |
| DE | 10106514 | A1 | 8/2002 | |
| DE | 60206490 | T2 | 5/2006 | |
| DE | 60302143 | | 8/2006 | |
| DE | 102005023428 | A1 | 11/2006 | |
| DE | 102005038433 | A1 | 2/2007 | |
| DE | 102007007133 | A1 | 8/2008 | |
| DE | 102007060195 | A1 | 6/2009 | |
| DE | 202010006739 | U1 | 8/2010 | |
| DE | 102009027910 | A1 | 1/2011 | |
| DE | 102009028278 | A1 | 2/2011 | |
| DE | 102011052846 | A1 | 5/2012 | |
| DE | 102012103435 | A1 | 12/2012 | |
| EP | 0068974 | A1 | 1/1983 | |
| EP | 0178202 | A1 | 4/1986 | |
| EP | 0198496 | A1 | 10/1986 | |
| EP | 0208900 | A2 | 1/1987 | |
| EP | 0370552 | A1 | 5/1990 | |
| EP | 0374616 | A1 | 6/1990 | |
| EP | 0383028 | A2 | 8/1990 | |
| EP | 0405627 | A1 | 1/1991 | |
| EP | 437189 | A1 | 7/1991 | |
| EP | 0454640 | A1 | 10/1991 | |
| EP | 0521815 | A1 | 1/1993 | |
| EP | 0585905 | A2 | 9/1993 | |
| EP | 0702928 | A1 | 8/1995 | |
| EP | 0597907 | B1 | 12/1995 | |
| EP | 0725182 | A1 | 8/1996 | |
| EP | 0748607 | A2 | 12/1996 | |
| EP | 752231 | A1 | 1/1997 | |
| EP | 0752231 | A1 | 1/1997 | |
| EP | 0854311 | A2 | 7/1998 | |
| EP | 0855165 | A2 | 7/1998 | |
| EP | 0898928 | A1 | 3/1999 | |
| EP | 1029965 | A1 | 8/2000 | |
| EP | 1224902 | A2 | 7/2002 | |
| EP | 1256308 | A2 | 11/2002 | |
| EP | 1264570 | | 12/2002 | |
| EP | 1319360 | A1 | 6/2003 | |
| EP | 1342827 | | 9/2003 | |
| EP | 1346680 | A2 | 9/2003 | |
| EP | 1386575 | A1 | 2/2004 | |
| EP | 1415587 | | 5/2004 | |
| EP | 1498065 | A1 | 1/2005 | |
| EP | 1583455 | A1 | 10/2005 | |
| EP | 1703834 | A1 | 9/2006 | |
| EP | 1743871 | A1 | 1/2007 | |
| EP | 1862104 | A1 | 12/2007 | |
| EP | 1882436 | A1 | 1/2008 | |
| EP | 1980193 | A1 | 10/2008 | |
| EP | 2127587 | A1 | 2/2009 | |
| EP | 2075366 | A1 | 7/2009 | |
| EP | 2138087 | A1 | 12/2009 | |
| EP | 2332457 | A1 | 6/2011 | |
| FR | 1370521 | A | 8/1964 | |
| FR | 2372363 | A1 | 6/1978 | |
| FR | 2491320 | A1 | 4/1982 | |
| FR | 2491321 | A1 | 4/1982 | |
| FR | 2790013 | A1 | 8/2000 | |
| GB | 973859 | A | 10/1964 | |
| GB | 1047948 | | 11/1966 | |
| GB | 1123789 | A | 8/1968 | |
| GB | 1515095 | | 6/1978 | |
| GB | 2274772 | A | 8/1994 | |
| IT | EP 0752231 | A1 * | 1/1997 | ..... A47L 15/4206 |
| JP | 55039215 | A | 3/1980 | |
| JP | 60069375 | A | 4/1985 | |
| JP | 61085991 | A | 5/1986 | |
| JP | 61200824 | A | 9/1986 | |
| JP | 1005521 | A | 1/1989 | |
| JP | 1080331 | A | 3/1989 | |
| JP | 5245094 | A | 9/1993 | |
| JP | 07178030 | | 7/1995 | |
| JP | 10109007 | A | 4/1998 | |
| JP | 2000107114 | A | 4/2000 | |
| JP | 2001190479 | A | 7/2001 | |
| JP | 2001190480 | A | 7/2001 | |
| JP | 2003336909 | A | 12/2003 | |
| JP | 2003339607 | A | 12/2003 | |
| JP | 2004267507 | A | 9/2004 | |
| JP | 2005124979 | A | 5/2005 | |
| JP | 2006075635 | A | 3/2006 | |
| JP | 2007068601 | A | 3/2007 | |
| JP | 2008093196 | A | 4/2008 | |
| JP | 2008253543 | A | 10/2008 | |
| JP | 2008264018 | A | 11/2008 | |
| JP | 2008264724 | A | 11/2008 | |
| JP | 2010035745 | A | 2/2010 | |
| JP | 2010187796 | A | 9/2010 | |
| KR | 20010077128 | | 8/2001 | |
| KR | 20090006659 | | 1/2009 | |
| WO | 2005058124 | A1 | 6/2005 | |
| WO | 2005115216 | A1 | 12/2005 | |
| WO | 2007024491 | A2 | 3/2007 | |
| WO | 2007074024 | A1 | 7/2007 | |
| WO | 2008067898 | A1 | 6/2008 | |
| WO | 2008125482 | A2 | 10/2008 | |
| WO | 2009018903 | A1 | 2/2009 | |
| WO | 2009065696 | A1 | 5/2009 | |
| WO | 2009077266 | A1 | 6/2009 | |
| WO | 2009077279 | A2 | 6/2009 | |
| WO | 2009077280 | A1 | 6/2009 | |
| WO | 2009077283 | A1 | 6/2009 | |
| WO | 2009077286 | A1 | 6/2009 | |
| WO | 2009077290 | A1 | 6/2009 | |
| WO | 2009118308 | A1 | 10/2009 | |

OTHER PUBLICATIONS

German Search Report for Counterpart DE102013109125, Dec. 9, 2013.
German Search Report for Counterpart DE102014101260.7, Sep. 18, 2014.
German Search Report for DE102010061342, Aug. 19, 2011.
European Search Report for EP101952380, May 19, 2011.
Ishihara et al., JP 11155792 A, English Machine Translation, 1999, pp. 1-14.
European Search Report for EP11188106, Mar. 29, 2012.
European Search Report for EP12188007, Aug. 6, 2013.
German Search Report for DE102010061347, Jan. 23, 2013.
German Search Report for DE102010061215, Feb. 7, 2013.
German Search Report for DE102010061346, Sep. 30, 2011.
German Search Report for DE102010061343, Jul. 7, 2011.
German Search Report for DE102011053666, Oct. 21, 2011.
German Search Report for DE102013103264, Jul. 12, 2013.

* cited by examiner

REDUCED SOUND WITH A ROTATING FILTER FOR A DISHWASHER

CROSS-REFERENCE TO RELATED APPLICATIONS

This application is a continuation-in-part of U.S. application Ser. No. 13/483,254, filed May 30, 2012, now U.S. Pat. No. 9,237,836 issued Jan. 19, 2016, and entitled Rotating Filter for a Dishwasher, which is incorporated by reference herein in its entirety.

BACKGROUND OF THE INVENTION

A dishwasher is a domestic appliance into which dishes and other cooking and eating wares (e.g., plates, bowls, glasses, flatware, pots, pans, bowls, etc.) are placed to be washed. The dishwasher may include a filter system to remove soils from liquid circulated onto the dishes.

BRIEF DESCRIPTION OF EMBODIMENTS OF THE INVENTION

In one aspect, an embodiment of the invention relates to a dishwasher for treating dishes according to at least one automatic cycle of operation and configured to sit on a support surface, including a chassis having a portion sitting on the support surface, a tub supported by the chassis and at least partially defining a treating chamber for receiving the dishes for treatment, a sprayer proximate to the tub to spray liquid into the treating chamber, a circulation circuit defining a fluid flow path from the treating chamber to the sprayer through which the sprayed liquid may return from the treating chamber back to the sprayer, a rotating filter having opposing first and second surfaces, the rotating filter being positioned within the circulation circuit to filter soils from liquid flowing through the fluid flow path as the liquid passes through the rotating filter between the first and second surfaces and at least one flow diverter spaced apart from the first surface to define a gap through which at least some of the liquid passes as the liquid flows through the flow path, wherein the rotating filter has a first portion nearest the tub and a second portion nearest the support surface, and the at least one flow diverter is not located at one of a first space between the first portion and the tub or a second space between the second portion and the support surface.

In another aspect, an embodiment of the invention relates to a dishwasher for treating dishes according to at least one automatic cycle of operation, including a tub at least partially defining a treating chamber for receiving the dishes for treatment, a sprayer proximate to the tub to spray liquid into the treating chamber, a circulation circuit defining a fluid flow path from the treating chamber to the sprayer through which the sprayed liquid may return from the treating chamber back to the sprayer, a rotating filter having opposing first and second surfaces, the rotating filter being positioned within the circulation circuit to filter soils from liquid flowing through the fluid flow path as the liquid passes through the rotating filter between the first and second surfaces, a rotating filter having an outer surface and an inner surface and enclosing a hollow interior, the rotating filter being positioned within the circulation circuit to filter soils from liquid flowing through the fluid flow path as the liquid passes through the rotating filter, and multiple external flow diverter spaced apart from the outer surface of the rotating filter to define gaps between the multiple external flow diverters and the rotating filter and where the multiple external flow diverters are not transversely located around the rotating filter.

DESCRIPTION OF EMBODIMENTS OF THE INVENTION

Figure 1:
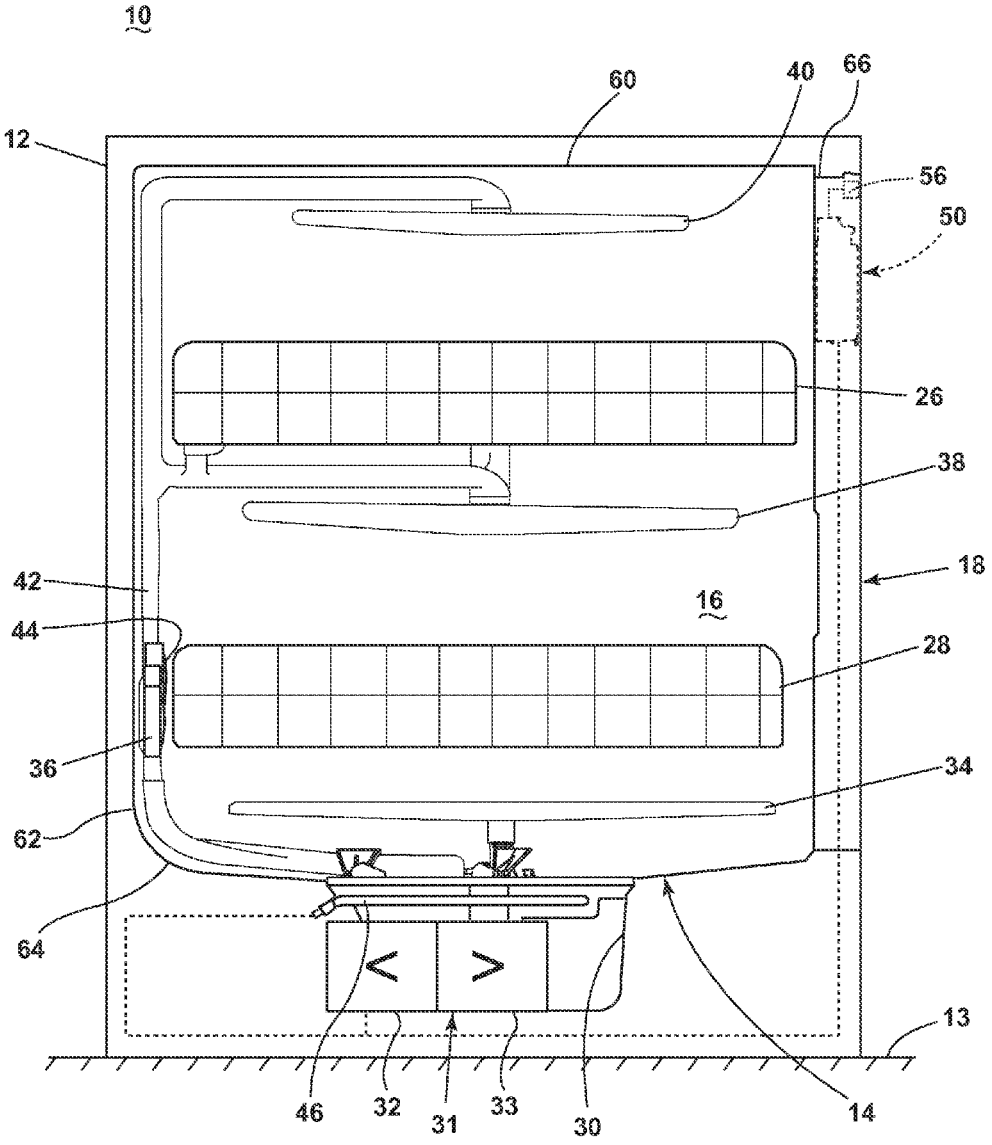
FIG. 1 is a schematic, cross-sectional view of a dishwasher according to a first embodiment of the invention.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. The chassis 12 may have a portion sitting on a support surface 13, such as a floor or pedestal. An open-faced tub 14 may be provided within the chassis 12 and may be supported by the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and includes sprayers provided in the form of a first lower spray assembly 34, a second lower spray assembly 36, a rotating mid-level spray arm assembly 38, and/or an upper spray arm assembly 40, which are proximate to the tub 14 to spray liquid into the treating chamber 16. Upper spray arm assembly 40, mid-level spray arm assembly 38 and lower spray assembly 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recessed portion of a bottom wall of the tub 14. The pump assembly 31 may include both a drain pump assembly 32 and a recirculation pump assembly 33. The drain pump assembly 32 may draw liquid from the sump 30 and pump the liquid out of the dishwasher 10 to a household drain line (not shown). The recirculation pump assembly 33 may be fluidly coupled between the treating chamber 16 and the spray system to define a circulation circuit for circulating the sprayed liquid. The circulation circuit may define a fluid flow path from the treating chamber 16 to the assemblies 34, 36, 38, 40 through which the sprayed liquid may return from the treating chamber 16 back to the assemblies 34, 36, 38, 40. More specifically, the recirculation pump assembly 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
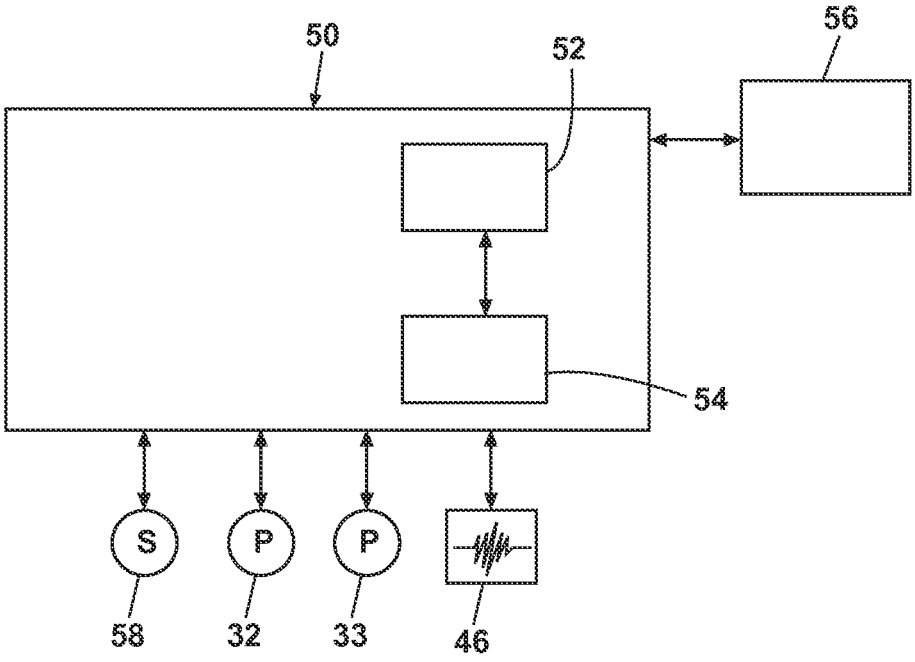
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump assembly 32 for draining liquid from the treating chamber 16, and the recirculation pump assembly 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
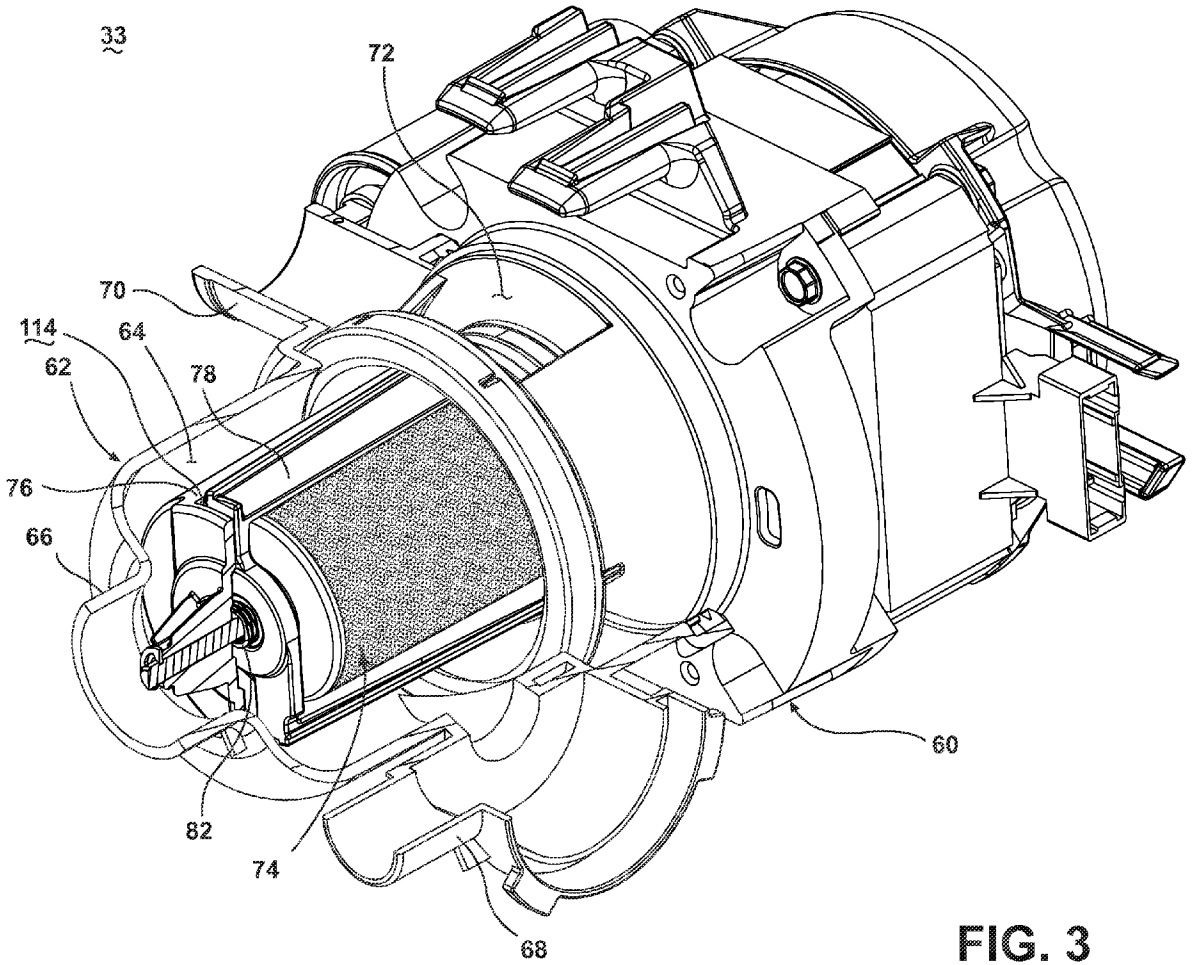
FIG. 3 is a perspective view of an embodiment of a pump and filter assembly of the dishwasher of FIG. 1 with portions cut away for clarity.

Referring now to FIG. 3, the recirculation pump assembly 33 is shown removed from the dishwasher 10. The recirculation pump assembly 33 includes a recirculation pump 60 that is secured to a housing 62, which is shown partially cutaway for clarity. The housing 62 defines a filter chamber 64 that extends the length of the housing 62 and includes an inlet port 66, a drain outlet port 68, and a recirculation outlet port 70. The inlet port 66 is configured to be coupled to a fluid hose (not shown) extending from the sump 30. The filter chamber 64, depending on the location of the recirculation pump assembly 33, may functionally be part of the sump 30 or replace the sump 30. The drain outlet port 68 for the recirculation pump 60, which may also be considered the drain pump inlet port, may be coupled to the drain pump assembly 32 such that actuation of the drain pump assembly 32 drains the liquid and any foreign objects within the filter chamber 64. The recirculation outlet port 70 is configured to receive a fluid hose (not shown) such that the recirculation outlet port 70 may be fluidly coupled to the liquid spraying system including the assemblies 34, 36, 38, 40. The recirculation outlet port 70 is fluidly coupled to an impeller chamber 72 of the recirculation pump 60 such that when the recirculation pump 60 is operated liquid may be supplied to each of the assemblies 34, 36, 38, 40 for selective spraying. In this manner, the recirculation pump 60 includes an inlet fluidly coupled to the tub 14 and an outlet fluidly coupled to the liquid spraying system to recirculate liquid from the tub 14 to the treating chamber 16.

Figure 4:
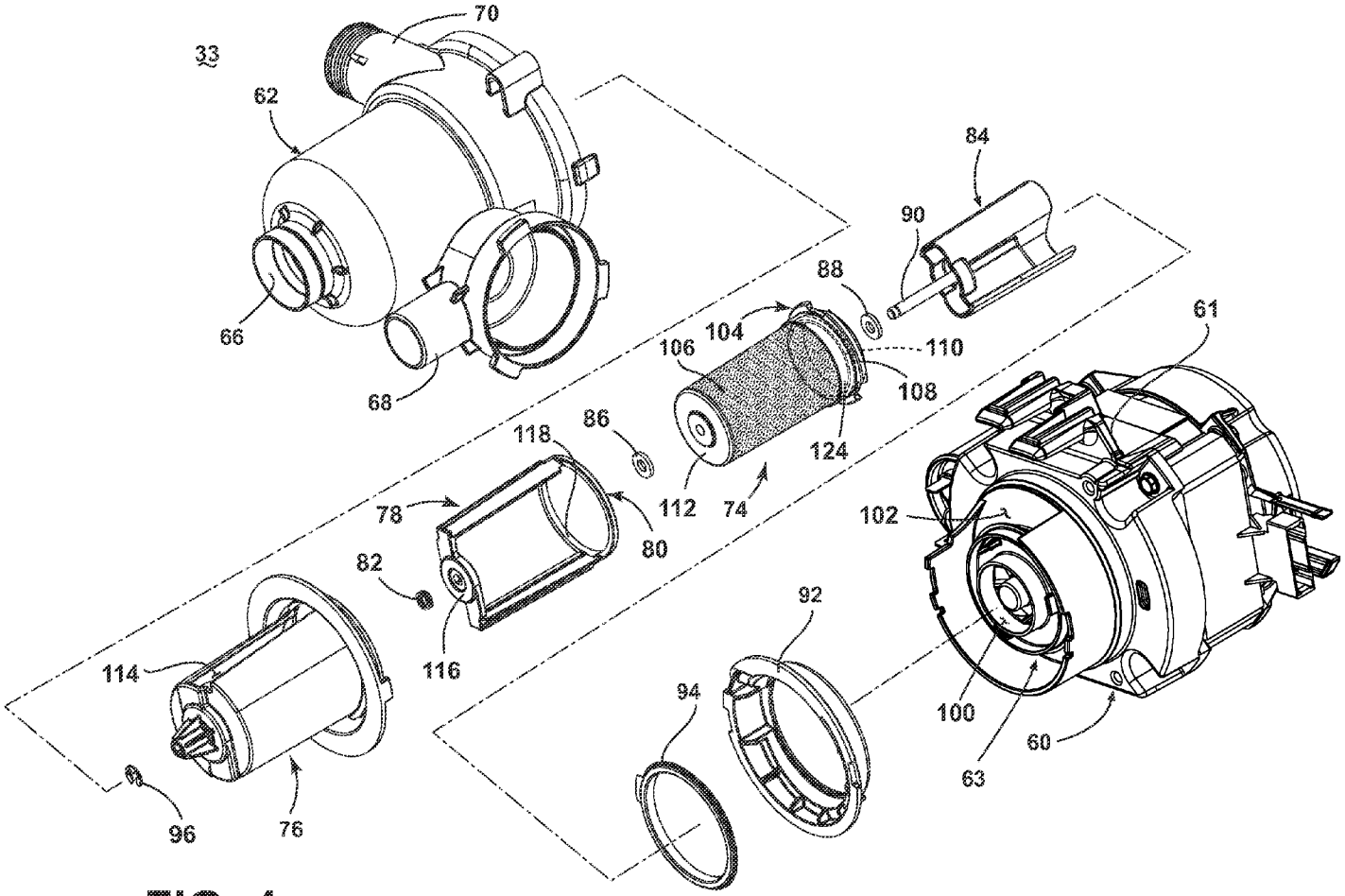
FIG. 4 is an exploded view of the pump and filter assembly of FIG. 2.

A liquid filtering system may be included within the recirculation pump assembly 33 and is illustrated as including a rotating filter 74, a shroud 76, and a first diverter 78. FIG. 4 more clearly illustrates that the recirculation pump assembly 33 may also include a diverter mount 80, a biasing element 82, a second diverter 84, a first bearing 86, a second bearing 88, a shaft 90, a separator ring 92, a floating ring 94, and a clip 96.

FIG. 4 also more clearly illustrates that the recirculation pump assembly 33 may also include a recirculation pump 60 having a motor 61 and an impeller 63, which may be rotatably driven by the motor 61. The pump 60 includes an inlet 100 and an outlet 102, both which are in fluid communication with the circulation circuit. The inlet 100 of the pump 60 may have an area of 660 to 810 $mm^2$ and the outlet 102 of the pump 60 may have an area of 450 to 500 $mm^2$. The recirculation pump 60 may also have an exemplary volumetric flow rate and the rate may be in the range of 15 liters per minute to 32 liters per minute. The motor 61 may be a variable speed motor having speeds ranging from between 2000 and 3500 rpm. Alternatively, the motor 61 may include a single speed motor having any suitable speed; for example, the motor 61 may have a speed of 3370 rpm+/−50 rpm. The general details of such a recirculation pump assembly 33 are described in the commonly-owned patent application entitled, Rotating Filter for a Dishwashing Machine, filed Jun. 20, 2011, and assigned U.S. application Ser. No. 13/163,945, which is incorporated by reference herein. The rotating filter 74 may be operably coupled to the impeller 63 such that rotation of the impeller 63 effects the rotation of the rotating filter 74.

The rotating filter 74 may include a hollow body formed by a frame 104 and a screen 106 and may have an exterior and an interior. The hollow body of the rotating filter 74 may be any suitable shape including that of a cone or a cylinder. The frame 104 is illustrated as including a first ring 108, a second ring 110, and an end portion 112. The screen 106 is supported by the frame 104 and the position of the screen 106 may be fixed relative to the frame 104. In the illustrated embodiment, the screen 106 is held between the first and second rings 108 and 110 of the frame 104. The first ring 108 extends beyond the screen 106 of the rotating filter 74 and includes a projection extending about a periphery of the hollow body of the screen 106.

The screen 106 may include a plurality of openings through which liquid may pass. The plurality of openings may have a variety of sizes and spacing. The sum of the individual areas of the plurality of openings within the screen 106 may define a cumulative open area for the body of the screen 106. The area of the body of the screen 106 exposed to the circulation circuit may define the body area of the screen 106. It is contemplated that the ratio of the open area to the body area of the screen 106 may be in the range of 0.15 to 0.40. The ratio may be a function of at least the area of one of the inlet 100 of the pump 60 and the outlet 102 of the pump 60. The pump 60 may also have a volumetric flow rate and the ratio of the open area to the body area of the screen 106 may be a function of the volumetric flow rate. The ratio of the open area to the body area of the screen 106 may also be a function of the rotational speed of the rotating filter 74 during operation. For example, the ratio being within the range of 0.15 to 0.40 may correlate to a rotational speed of the rotating filter 74 being between 2000 and 3500 rpm. In one embodiment the rotating filter 74 may include 0.160 mm diameter holes and about eighteen percent open area. Reducing the open area to twelve percent may reduce the motor wattage without lowering the pump pressure and the resulting rotating filter 74 may handle soils equally as well.

The shroud 76 may define an interior and may be sized to at least partially enclose the rotating filter 74. The shroud 76 may be fluidly accessible through multiple access openings 114. It is contemplated that the shroud 76 may include any number of access openings 114 including a singular access opening 114.

The first diverter 78 may be sized to extend along at least a portion of the rotating filter 74. The diverter mount 80 may be operably coupled to the first diverter 78 including that it may be formed as a single piece with the first diverter 78. The diverter mount 80 may include a first mount 116 and a diverter bearing surface 118. The first diverter 78 may extend between the first mount 116 and the diverter bearing surface 118.

Figure 5:
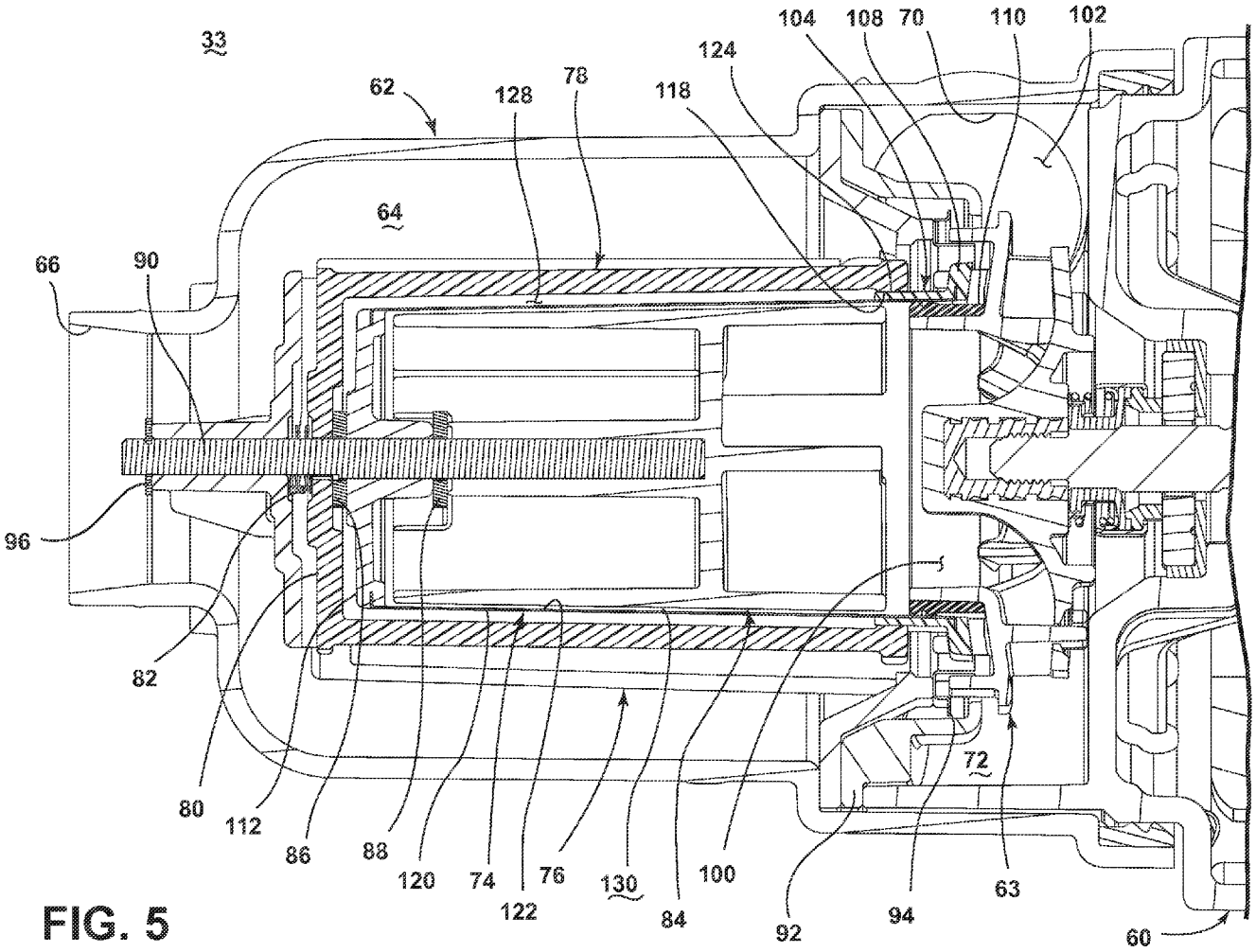
FIG. 5 is a cross-sectional view of the pump and filter assembly of FIG. 2 taken along the line 5-5 shown in FIG. 3.

As shown in FIG. 5, when assembled, the first bearing 86 may be mounted in an end of the rotating filter 74 and may rotatably receive the stationary shaft 90, which in turn may be mounted to an end of the shroud 76 through a retainer, such as the spring clip 96. The clip 96 may retain the shroud 76 on the stationary shaft 90 such that it does not slide or rotate. The first mount 116 of the diverter mount 80 may also be supported by the shaft 90 between the bearing 86 and the biasing element 82 and is configured to extend along a portion of the screen 106. The first diverter 78 and the diverter mount 80 are arranged such that the first diverter 78 may be located within the access opening 114 of the shroud 76. In the illustrated embodiment, the first diverter 78 projects through the access opening 114.

The second bearing 88 may be adjacent an inside portion of the rotating filter 74 and may rotatably receive the stationary shaft 90. The second bearing 88 may also separate the rotating filter 74 from the second diverter 84, which may also be mounted on the stationary shaft 90. In this way, the rotating filter 74 may be rotatably mounted to the stationary shaft 90 with the first bearing 86 and the second bearing 88 and the shroud 76, first diverter 78, and second diverter 84 may be stationary with the shaft 90.

The shroud 76 may be mounted at its other end to the separator ring 92. The separator ring 92 acts to separate the filtered water in the impeller chamber 72 from the mixture of liquid and soils in the filter chamber 64. The separator ring 92 may be located between the floating ring 94 and the recirculation pump 60 and may be axially moveable to aid in radially and vertically sealing with the separator ring 92.

The screen 106 may have a first surface 120 defining an upstream surface and a second surface 122 defining a downstream surface. The rotating filter 74 may be located within the circulation circuit such that the circulated liquid passes through the rotating filter 74 from the upstream surface defined by the first surface 120 to a downstream surface defined by the second surface 122. In this manner, recirculating liquid passes through the rotating filter 74 from the upstream surface to the downstream surface to effect a filtering of the liquid. In the described flow direction, the upstream surface correlates to the outer of first surface 120 of the rotating filter 74 and the downstream surface correlates to the inner or second surface 122 of the rotating filter 74 such that the rotating filter 74 separates the upstream portion of the filter chamber 64 from the outlet port 70. If the flow direction is reversed, the downstream surface may correlate with the outer of first surface 120 and the upstream surface may correlate with the inner or second surface 122.

The first diverter 78 may extend along and be spaced away from at least a portion of the upstream surface to define a gap 128 between the first diverter 78 and the rotating filter 74 with a first portion of the first diverter 78 being proximate the impeller 63 and the second portion of the first diverter 78 being distal the impeller 63. A filter bearing surface 124 is provided on the frame 104, which, as illustrated is an integral part of the frame 104, though it need not be. At least part of the frame 104 may form a filter bearing surface 124. In the illustrated example, the filter bearing surface 124 includes the first ring 108. More specifically, a portion of the first ring 108 projecting beyond the screen 106 forms the filter bearing surface 124. When assembled, the diverter bearing surface 118 and the filter bearing surface 124 are in an abutting relationship to define a floating relative relationship between the first diverter 78 and the rotating filter 74. The rotating filter 74 and first diverter 78 are arranged such that when the filter bearing surface 124 and diverter bearing surface 118 are in contact, the first diverter 78 is spaced from the screen 106 to form the gap 128 between the first diverter 78 and the screen 106. The gap 128 may be in a range of 0.25 mm to 1 mm and is preferably around 0.5 mm. In the illustrated embodiment, the internal or second diverter 84 may be proximate the downstream surface to define a second gap 130. The gap 130 may be in a range of 0.5 mm to 2 mm and is preferably around 0.75 mm. Thus, the first diverter 78 may be proximate the exterior of the rotating filter 74 and the second diverter 84 may be proximate the interior of the rotating filter 74.

In the illustrated embodiment, the hollow body of the rotating filter 74 is cone shaped and the first diverter 78 is positioned such that the gap 128 is substantially constant relative to the rotating filter 74. The diverter mount 80 may operably couple the first diverter 78 to the rotating filter 74 such that there is only one tolerance stack up between at least a portion of the first diverter 78 and a portion of the rotating filter 74. More specifically, the diverter bearing surface 118 and the filter bearing surface 124 are in contact during rotation of the rotating filter 74 to form the one tolerance stack up.

The biasing element 82 may bias the first diverter 78 into position relative to the rotating filter 74 to form the gap 128. The biasing element 82 may bias the first diverter 78 and the rotating filter 74 into a fixed relative axial position, which may be of particular importance when the rotating filter 74 is a cone with a varying diameter and of less importance if the rotating filter 74 and first diverter 78 are of constant diameter, such as a cylinder. More specifically the biasing element 82 may bias the second portion of the first diverter 78 toward an end of the rotating filter 74 proximate the first ring 108 to maintain the first diverter 78 and the rotating filter 74 in the fixed relative position. In the illustrated example, the biasing element biases both of the first diverter and the rotating filter 74 toward the impeller 63. The biasing element 82 may be any suitable biasing element 82 including a compression spring. The biasing element 82 may also bias the rotating filter 74 and the first diverter 78 such that the filter bearing surface 124 and the diverter bearing surface 118 contact each other to form the one tolerance stack up. In the event that the assembly does not include the diverter mount, the biasing element 82 and the first diverter 78 may be configured such that the biasing element 82 may bias the first diverter 78, itself, toward a first end of the rotating filter 74 to maintain the first diverter 78 and rotating filter 74 in a fixed relative position.

In operation, wash liquid, such as water and/or treating chemistry (i.e., water and/or detergents, enzymes, surfactants, and other cleaning or conditioning chemistry), enters the tub 14 and flows into the sump 30 to the inlet port 66 where the liquid may enter the filter chamber 64. As the filter chamber 64 fills, liquid passes through the perforations in the rotating filter 74. After the filter chamber 64 is completely filled and the sump 30 is partially filled with liquid, the dishwasher 10 activates the motor 61. During an operation cycle, a mixture of liquid and foreign objects such as soil particles may advance from the sump 30 into the filter chamber 64 to fill the filter chamber 64.

Activation of the motor 61 causes the impeller 63 and the rotating filter 74 to rotate. The liquid in the recirculation flow path flows into the filter chamber 64 from the inlet port 66. The rotation of the filter 74 causes the liquid and soils therein to rotate in the same direction within the filter chamber 64. The recirculation flow path may circumscribe at least a portion of the shroud 76 and enters through access openings 114 therein. The rotation of the impeller 63 draws liquid from the filter chamber 64 and forces the liquid by rotation of the impeller 63 outward such that it is advanced out of the impeller chamber 72 through the recirculation outlet port 70 to the assemblies 34, 36, 38, 40 for selective spraying. When liquid is delivered to the assemblies 34, 36, 38, 40, it is expelled from the assemblies 34, 36, 38, 40 onto any dishes positioned in the treating chamber 16. Liquid removes soil particles located on the dishes, and the mixture of liquid and soil particles falls onto the bottom wall of the tub 14. The sloped configuration of the bottom wall of the tub 14 directs that mixture into the sump 30. The recirculation pump 60 is fluidly coupled downstream of the downstream surface of the rotating filter 74 and if the recirculation pump 60 is shut off then any liquid and soils within the filter chamber will settle in the filter chamber 64 where the liquid and any soils may be subsequently drained by the drain pump assembly 32.

Figure 6:
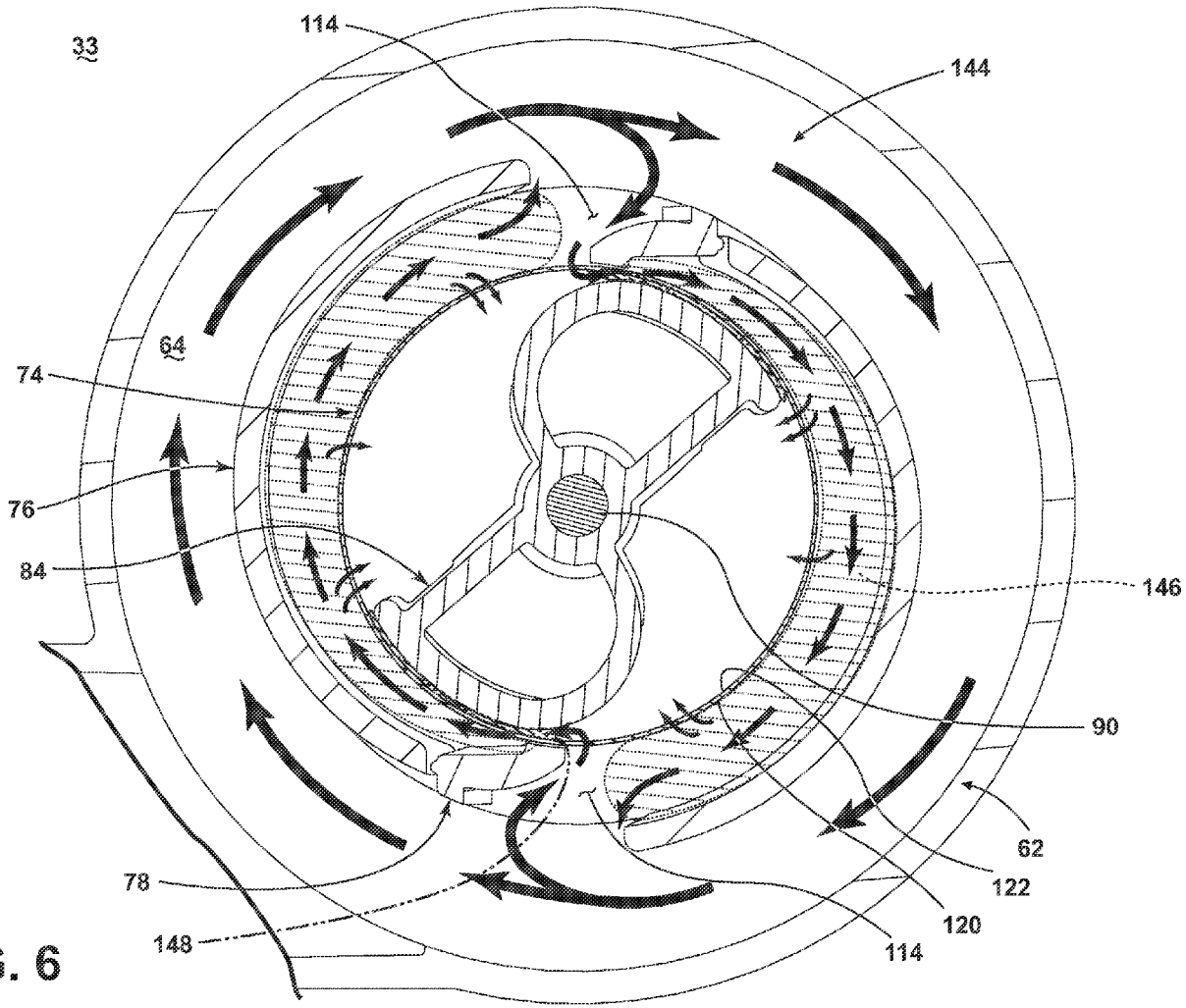
FIG. 6 is a cross-sectional elevation view of a portion of the pump and filter assembly of FIG. 3.

FIG. 6 illustrates more clearly the shroud 76, first diverter 78, the second diverter 84, and the flow of the liquid along the recirculation flow path. Multiple arrows 144 illustrate the travel of liquid along the recirculation flow path as it passes through the rotating filter 74 from the upstream surface defined by the first surface 120 to a downstream surface defined by the second surface 122. The rotation of the filter 74, which is illustrated in the clockwise direction, causes the liquid and soils therein to rotate in the same direction within the filter chamber 64. The recirculation flow path is thus illustrated as circumscribing at least a portion of the shroud 76 and as entering through the access openings 114. In this manner, the multiple access openings 114 may be thought of as facing downstream to the recirculation flow path. It is possible that some of the liquid in the recirculation flow path may make one or more complete trips around the shroud 76 prior to entering the access openings 114. The number of trips is somewhat dependent upon the suction provided by the recirculation pump 60 and the rotation of the filter 74. As may be seen, a small portion of the liquid may be drawn around the shroud 76 and into the access opening 114 in a direction opposite that of the rotation of the filter 74. The shape of the shroud 76, the first diverter 78, and the second diverter 84 as well as the suction from the recirculation pump 60 may result in a portion of the liquid turning in this manner, which helps discourage foreign objects from entering the access opening 114 as they are less able to make the same turn around the shroud 76 and into the access opening 114.

Several of the zones created in the filter chamber 64 during operation have also been illustrated and include: a first shear force zone 146 and a second shear force zone 148. These zones impact the travel of the liquid along the liquid recirculation flow path as described in detail in the U.S. patent application Ser. No. 13/163,945, filed on Jun. 20, 2011, entitled "Rotating Filter for a Dishwasher," which is incorporated by reference herein in its entirety. It will be understood that the shroud 76 and the first diverter 78 form artificial boundaries spaced from the upstream surface defined by the first surface 120 of the rotating filter 74 such that liquid passing between the shroud 76 and the first diverter 78 and the upstream surface applies a greater shear force on the first surface 120 than liquid in an absence of the shroud 76 and the first diverter 78 and that in this manner the first shear force zone 146 is formed. Similarly, the second diverter 84 forms a second artificial boundary spaced from the downstream surface defined by the second surface 122 of the rotating filter 74 and creates the second shear force zone 148. The first and second shear force zones 146 and 148 aid in removing foreign soil from the rotating filter 74. Additional zones may be formed by the shroud 76, the first diverter 78, and the second diverter 84 as described in detail in the U.S. patent application Ser. No. 13/163,945. It is contemplated that the relative orientation between the first diverter 78 and the second diverter 84 may be changed to create variations in the zones formed.

In another embodiment, at least a first portion of the first diverter 78 may be in a floating relative relationship with the rotating filter 74. In such an embodiment the first diverter 78 may still include the first diverter bearing surface 118 and the rotating filter 74 may still include a filter bearing surface 124, with the first diverter bearing surface 118 and the filter bearing surface 124 being in an abutting relationship to define the floating relative relationship. In yet another embodiment, a biasing device may be utilized to bias the first diverter 78 into position relative to the rotating filter 74 to form the gap 128. For example, a biasing device in the form of a spring may be used to space the first diverter 78 from the rotating filter 74. The biasing device may also allow the first diverter 78 to be moveable relative to at least a portion of the rotating filter 74 to allow the size of the gap 128 to vary with a position of the first diverter 78 relative to the surface of the rotating filter 74. Such embodiments would operate similarly to the embodiment described above and may reduce damage to the rotating filter 74 caused by soil particles between the first diverter 78 and the rotating filter 74.

In the home appliance industry, sound is an important consideration as a user's satisfaction with the appliance may be hindered with increased appliance noise. While the rotating filter and flow diverters allow for excellent filtration of soils from recirculated liquid the use of the flow diverters may increase the sound produced by the dishwasher. The remaining embodiments describe a variety of ways to reduce the amount of sound created by a dishwasher having a rotating filter and flow diverters.

Figure 7:
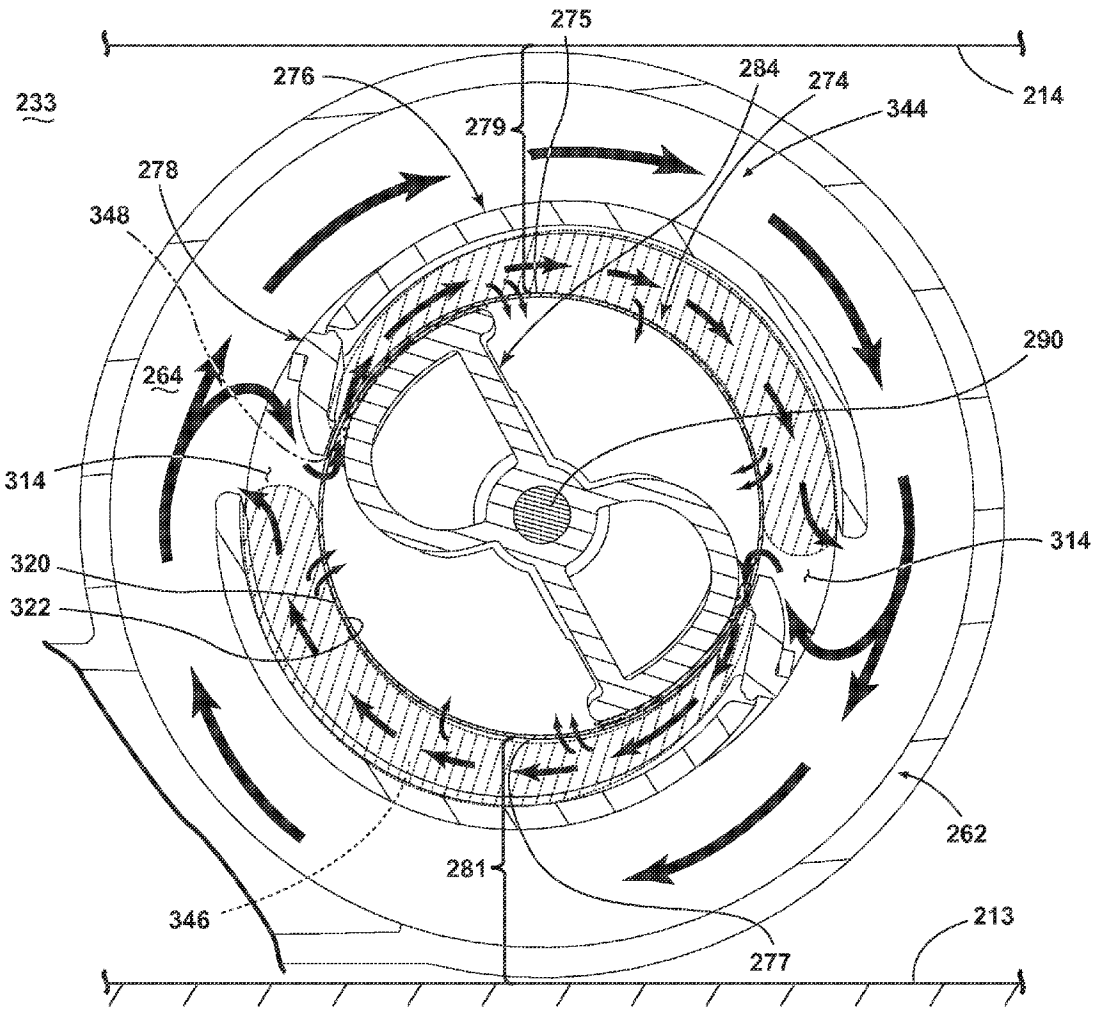
FIG. 7 is a cross-sectional elevation view of a portion of an alternative pump and filter assembly according to an embodiment of the invention.

FIG. 7 illustrates a cross-sectional view of an alternative recirculation pump assembly 233 according to a second embodiment of the invention. The recirculation pump assembly 233 is similar to the recirculation pump assembly 33 previously described and therefore, like parts will be identified with like numerals increased by 200, with it being understood that the description of the like parts of the recirculation pump assembly 33 applies to the recirculation pump assembly 233, unless otherwise noted.

While this need not be the case, the recirculation pump assembly 233 has been illustrated much like the first embodiment for comparative purposes. The recirculation pump assembly 233 has been illustrated as including a rotating filter 274 that defines a hollow interior, the first surface 320 is an external surface, and the second surface 322 is an internal surface. Further, at least a first portion of the diverter 278 is in a floating relative relationship with the rotating filter 274 and a shroud 276 at least partially encloses the rotating filter 274 and has an access opening 314, with the external diverter 278 located within the access opening 314. Further, a second flow diverter 284 is positioned within the hollow interior and spaced apart from an inner surface 322 of the rotating filter 274.

One difference between the recirculation pump assembly 33 and the recirculation pump assembly 233 is that the rotating filter 274 is illustrated as having a first portion 275 nearest the tub 214 and a second portion 277 nearest the support surface 213. While the tub 214 and the support surface 213 have been schematically illustrated very near the housing 262, it will be understood that the tub 214 and the support surface 213 may be spaced from the housing 262 in any suitable manner including that other components may be between the housing 262 and the tub 214 and/or the support surface 213. In the illustrated embodiment, the flow diverters 278 are not located at a first space 279 between the first portion 275 and the tub 214 or a second space 281 between the second portion 277 and the support surface 213. Limiting the locations of the flow diverters 278 such that they are not located within the first space 279 and the second space 281 is believed to decrease appliance noise, which increases user satisfaction, by providing for any acoustic waves emanating from the access openings 314 do not directly impact either the tub 214 or support surface 213, which produces less vibration of the tub 214 or support surface, thereby reducing the sound transferred to the surrounding environment.

While the flow diverters 278 are illustrated as being not located in either of the first space 279 or the second space 281, it is contemplated that if multiple flow diverters 278 are used that the one of the flow diverters 278 may be located in one of the first space 279 or the second space 281 and that this may still result in noise reduction. Further, although two external flow diverters have been illustrated it will be understood that any number of flow diverters may be utilized. So long as one of the first space and the second space are free of such flow diverters noise reduction may be achieved. The use of only a single external flow diverter may also reduce the noise created as a smaller number of shear force zones would be created.

While the recirculation pump assembly 233 has been illustrated in the above manner, it will be understood that the advantages of sound reduction achieved when the flow diverters are not located in the first and second spaces as described above may be realized in a variety of different configurations. Thus, it will be understood that embodiments related to the invention may include any suitable rotating filter having opposing first and second surfaces with the rotating filter being positioned within the circulation circuit to filter soils from liquid flowing through the fluid flow path as the liquid passes through the rotating filter between the first and second surfaces. For example, the rotating filter may be a hollow rotating filter shaped like a cylinder, cone, etc. or the rotating filter may be a rotating disk, other non-hollow shape, etc. Further still, any number and type of flow diverters may be used including that the flow diverters may have various shapes as described in detail in the U.S. patent application Ser. No. 14/268,282, filed May 2, 2014, and entitled Rotating Filter for a Dishwashing Machine, which is incorporated by reference herein in its entirety. Further still, a shroud, second flow diverter, and other aspects of the recirculation pump assembly may be modified or removed.

Figure 8:
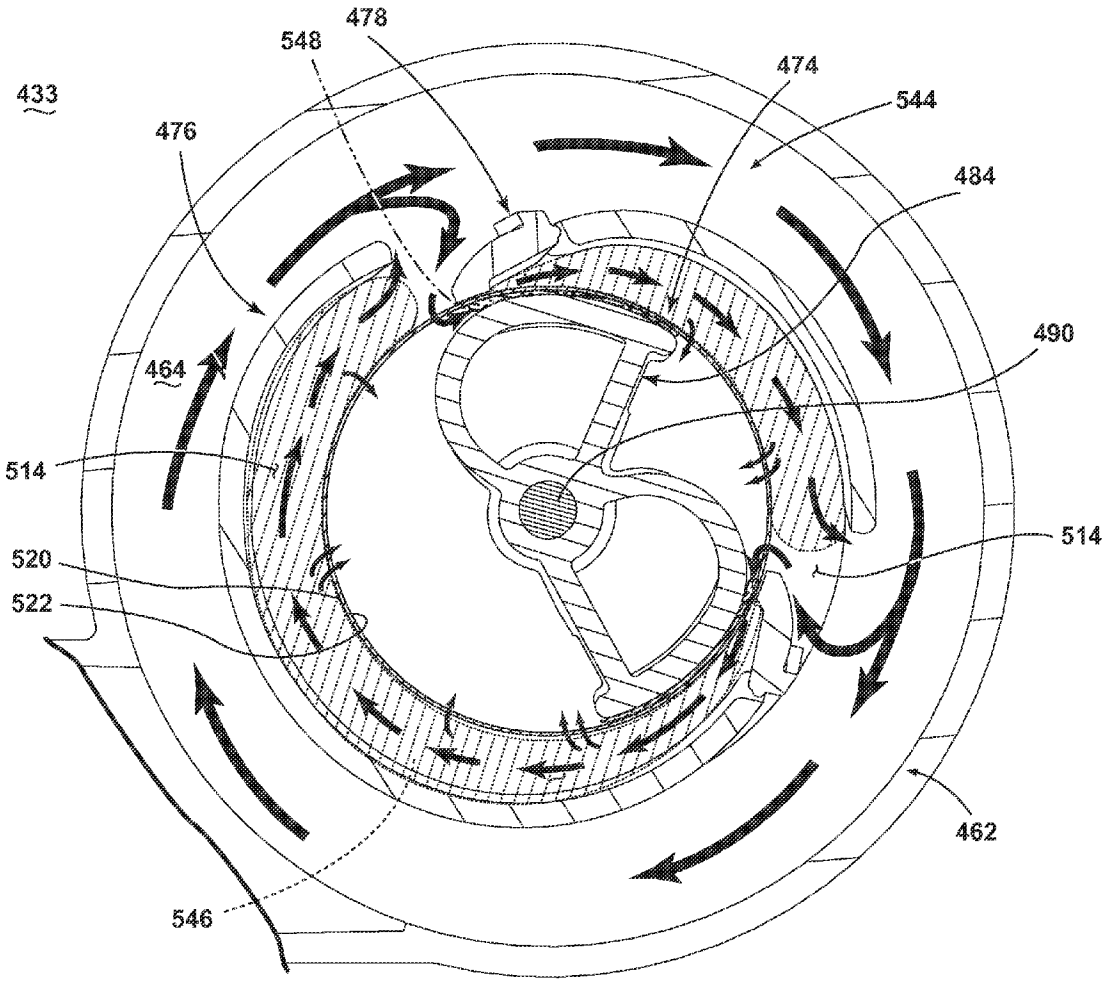
FIG. 8 is a cross-sectional elevation view of a portion of another alternative pump and filter assembly according to an embodiment of the invention.

FIG. 8 illustrates a cross-sectional view of an alternative recirculation pump assembly 433 according to a third embodiment of the invention. The recirculation pump assembly 433 is similar to the recirculation pump assembly 33 previously described and therefore, like parts will be identified with like numerals increased by 400, with it being understood that the description of the like parts of the recirculation pump assembly 33 applies to the recirculation pump assembly 433, unless otherwise noted.

The recirculation pump assembly 433 includes the same number of external and internal flow diverters as the recirculation pump assembly 33 but they are oriented in a manner to reduce the noise created. More specifically, the multiple external flow diverters 478 are not transversely located around the rotating filter 474 from each other. In the illustrated example, the multiple external flow diverters 478 are not evenly spaced around the rotating filter 474. While the internal flow diverter 284 has been modified to match the unevenly spaced external flow diverters 478, it is contemplated that multiple internal flow diverters may be positioned within the hollow interior and spaced apart from the inner surface 522 of the rotating filter 474 and that such multiple internal flow diverters may also not be transversely located and/or evenly spaced within the rotating filter 474.

Figure 9:
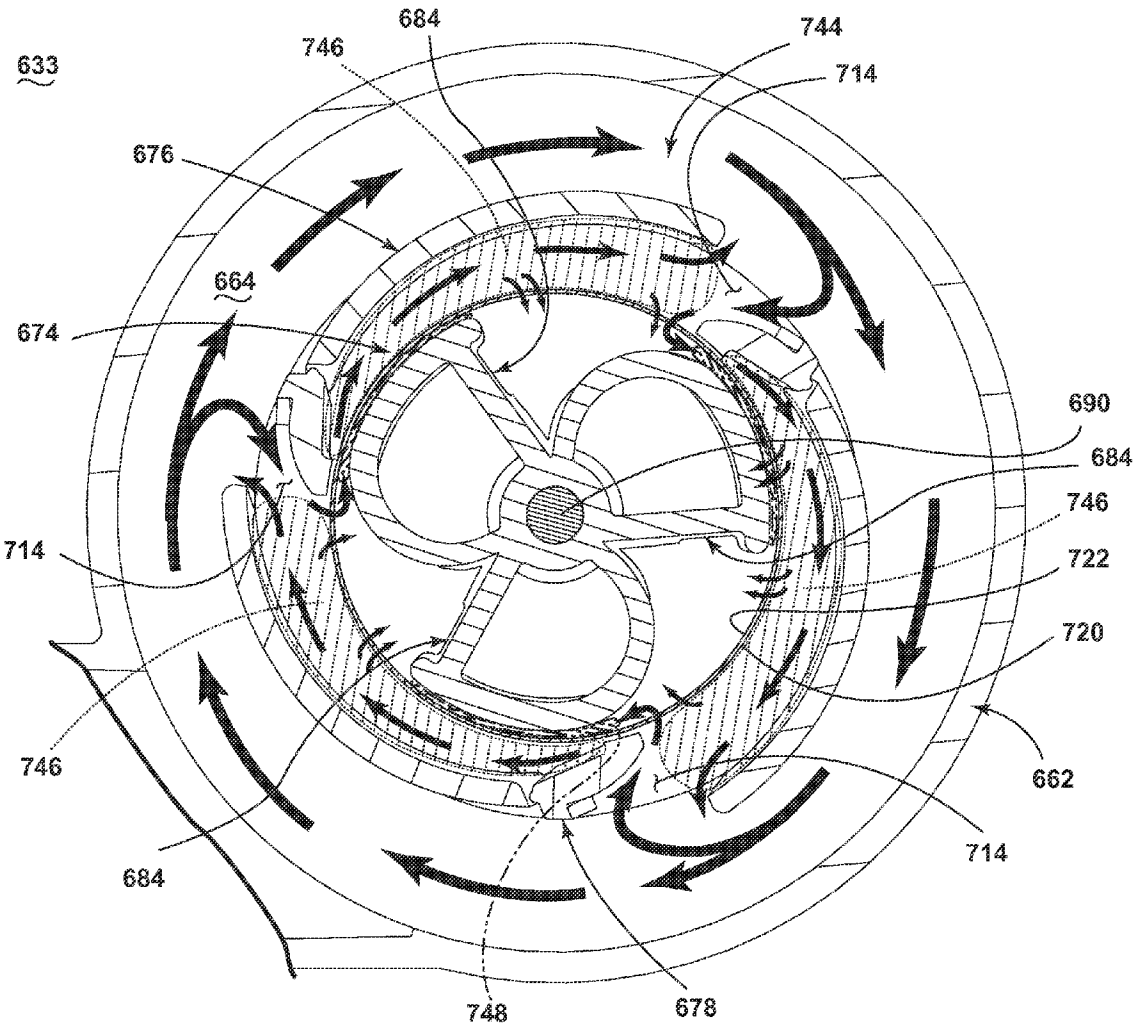
FIG. 9 is a cross-sectional elevation view of a portion of yet another alternative pump and filter assembly according to an embodiment of the invention.

FIG. 9 illustrates a cross-sectional view of an alternative recirculation pump assembly 633 according to a fourth embodiment of the invention. The recirculation pump assembly 633 is similar to the recirculation pump assembly 433 previously described and therefore, like parts will be identified with like numerals increased by 200, with it being understood that the description of the like parts of the recirculation pump assembly 433 applies to the recirculation pump assembly 633, unless otherwise noted. Like the recirculation pump assembly 433 the recirculation pump assembly 633 has been illustrated as including multiple external flow diverters 678 that are not transversely located around the rotating filter 674 from each other. However, one difference is that the recirculation pump assembly 633 has been illustrated as having an odd number of external flow diverters 678. While the odd number of multiple external flow diverters 678 are illustrated as being evenly spaced around the rotating filter 674 it is contemplated that they may be unevenly spaced so long as they are not transversely located.

It is again contemplated that any number of multiple external flow diverters may be included and spaced in a manner such that they are not transversely located from each other. While the recirculation pump assemblies 433 and 633 have been illustrated in the above manners, it will be understood that the advantages of sound reduction achieved when the external flow diverters are not located transversely from each other may be realized in a variety of different configurations. Thus, it will be understood that embodiments related to the invention may include any suitable rotating filter including a cylinder, cone, etc. Further still, any number and type of multiple external flow diverters may be used including that the flow diverters may have various shapes as described in detail in the U.S. patent application Ser. No. 14/268,282, filed May 2, 2014, and entitled Rotating Filter for a Dishwashing Machine, which is incorporated by reference herein in its entirety. Further still, a shroud, second flow diverter, and other aspects of the recirculation pump assembly may be modified or removed.

The embodiments described above provide for a variety of benefits including enhanced filtration such that soil is filtered from the liquid and not re-deposited on dishes and allow for cleaning of the rotating filter throughout the life of the dishwasher and this maximizes the performance of the dishwasher. Thus, such embodiments require less user maintenance than required by typical dishwashers. Further, several of the above embodiments result in decreased noise production during operation.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, the rotating filter may have first and second filter elements, which may be affixed to each other or may be spaced apart from each other by a gap. The filter elements may be structurally different from each other, may be made of different materials, and may have different properties attributable to them. For example, the first filter element may be more resistant to foreign object damage than the second filter element. It is also contemplated that the rotating filter may also include a non-perforated portion. The non-perforated portion may encircle the rotating filter and may act as a strengthening rib. The non-perforated portion may be for any given surface area and may provide the rotating filter with greater strength, especially hoop strength. It is also contemplated that the plurality of openings of the screen may be arranged to leave non-perforated bands encircling the screen with the non-perforated bands functioning as strengthening ribs.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

The patentable scope of the invention is defined by the claims, and may include other examples that occur to those skilled in the art. It will be understood that any features of the above described embodiments may be combined in any manner. Reasonable variation and modification are possible within the scope of the forgoing disclosure and drawings without departing from the spirit of the invention which is defined in the appended claims.

What is claimed is:

1. A dishwasher for treating dishes according to at least one automatic cycle of operation and configured to sit on a support surface, comprising:

a chassis having a portion sitting on the support surface;

a tub supported by the chassis and at least partially defining a treating chamber for receiving the dishes for treatment;

a sprayer proximate to the tub to spray liquid into the treating chamber;

a circulation circuit defining a fluid flow path from the treating chamber to the sprayer through which the sprayed liquid may return from the treating chamber back to the sprayer;

a housing defining a sump having an inlet fluidly coupled to the tub and an outlet fluidly coupled to the sprayer;

a rotating filter, located within the housing, having opposing first and second surfaces, the rotating filter being positioned within the circulation circuit to filter soils from liquid flowing through the fluid flow path as the liquid passes through the rotating filter between the first and second surfaces; and at least one flow diverter having a body formed substantially concentrically outside the rotating filter and spaced apart from the first surface to define a gap through which at least some of the liquid passes as the liquid flows through the flow path;

wherein the rotating filter has a first portion nearest the tub and a second portion nearest the support surface, and where no flow diverter is located at one of a first space between the first portion and the tub or a second space between the second portion and the support surface and where liquid passing through the gap between the at least one flow diverter and the rotating filter applies a greater shear force on the first surface than liquid in an absence of the at least one flow diverter, and wherein a gap between the at least one flow diverter and the rotating filter is a uniform distance along an entire length of the filter.

2. The dishwasher of claim 1 wherein no flow diverter is located in either of the first and second spaces.

3. The dishwasher of claim 2, further comprising multiple external flow diverters and wherein each has a body spaced apart from the first surface to define a uniform gap through which at least some of the liquid passes as the liquid flows through the flow path.

4. The dishwasher of claim 1 wherein the rotating filter defines a hollow interior and the first surface is an external surface and the second surface is an internal surface.

5. The dishwasher of claim 4, further comprising a second flow diverter positioned within the hollow interior and spaced apart from an inner surface of the rotating filter.

6. The dishwasher of claim 4 wherein at least a first portion of the at least one flow diverter is in a floating relative relationship with the rotating filter.

7. The dishwasher of claim 6, further comprising a shroud at least partially enclosing the rotating filter and having an access opening, with the at least one flow diverter located within the access opening.

8. The dishwasher of claim 4 wherein the rotating filter defines a hollow cone.

9. The dishwasher of claim 1, further comprising a wash pump including an impeller operably coupled to the rotating filter.

10. A dishwasher for treating dishes according to at least one automatic cycle of operation, comprising:

a tub at least partially defining a treating chamber for receiving the dishes for treatment;

a sprayer proximate to the tub to spray liquid into the treating chamber;

a circulation circuit defining a fluid flow path from the treating chamber to the sprayer through which the sprayed liquid may return from the treating chamber back to the sprayer;

a housing defining a sump having an inlet fluidly coupled to the tub and an outlet fluidly coupled to the sprayer;

a rotating filter, located within the housing, having an outer surface and an inner surface and enclosing a hollow interior, the rotating filter being positioned within the circulation circuit to filter soils from liquid flowing through the fluid flow path as the liquid passes through the rotating filter; and multiple external flow diverters formed substantially concentrically outside the rotating filter and spaced apart from the outer surface of the rotating filter to define gaps between the multiple external flow diverters and the rotating filter and where the multiple external flow diverters are not transversely located around the rotating filter such that none of the multiple external flow diverters are located 180 degrees from another of the multiple external flow diverters;

wherein liquid passing through the gaps between the multiple external flow diverters and the rotating filter applies a greater shear force on the outer surface than liquid in an absence of the multiple external flow diverters and where a gap between one of the multiple external flow diverters and the rotating filter is a uniform distance along an entire length of the filter.

11. The dishwasher of claim 10 wherein the multiple external flow diverters are not evenly spaced around the rotating filter.

12. The dishwasher of claim 10 wherein there is an odd number of external flow diverters.

13. The dishwasher of claim 12 wherein the multiple external flow diverters are evenly spaced around the rotating filter.

14. The dishwasher of claim 10, further comprising multiple internal flow diverters positioned within the hollow interior and spaced apart from the inner surface of the rotating filter.

15. The dishwasher of claim 14 wherein the multiple internal flow diverters are not transversely located within the rotating filter.

16. The dishwasher of claim 15 wherein the multiple internal flow diverters are not evenly spaced around the rotating filter.

17. The dishwasher of claim 10 wherein at least a portion of each of the multiple external diverters is in a floating relative relationship with the rotating filter.

18. The dishwasher of claim 17, further comprising a shroud at least partially enclosing the rotating filter and having multiple access openings, with at least one of the multiple external flow diverters located within each of the access openings.

19. The dishwasher of claim 10 wherein the rotating filter defines a hollow cone.

20. The dishwasher of claim 10, further comprising a wash pump including an impeller operably coupled to the rotating filter.

* * * * *